US012491405B1

(12) United States Patent
Hall et al.

(10) Patent No.: US 12,491,405 B1
(45) Date of Patent: Dec. 9, 2025

(54) LAT PULLOVER WITH POP PIN ADJUSTMENT

(71) Applicant: Arsenal Strength LLC, Knoxville, TN (US)

(72) Inventors: Richard Andrew Hall, Knoxville, TN (US); Nathan Lillie, Marquette, MI (US); Bradley J. Holt, Franklin, TN (US)

(73) Assignee: Arsenal Strength LLC, Knoxville, TN (US)

( * ) Notice: Subject to any disclaimer, the term of this patent is extended or adjusted under 35 U.S.C. 154(b) by 0 days.

(21) Appl. No.: 18/962,803

(22) Filed: Nov. 27, 2024

(51) Int. Cl.
*A63B 23/12* (2006.01)
*A63B 21/00* (2006.01)
*A63B 21/062* (2006.01)

(52) U.S. Cl.
CPC ..... *A63B 23/1209* (2013.01); *A63B 21/4035* (2015.10); *A63B 21/4039* (2015.10); *A63B 21/00181* (2013.01); *A63B 21/0628* (2015.10); *A63B 21/4034* (2015.10); *A63B 2225/093* (2013.01)

(58) Field of Classification Search
CPC ..... A63B 23/1209; A63B 21/4035; A63B 21/4039; A63B 21/00181; A63B 21/0628; A63B 21/4034; A63B 2225/093
See application file for complete search history.

(56) References Cited

U.S. PATENT DOCUMENTS 4,730,829 A * 3/1988 Carlson ..... A63B 21/4001 482/901
5,277,684 A * 1/1994 Harris ..... A63B 23/03533 482/121
5,447,480 A 9/1995 Fulks
5,580,341 A * 12/1996 Simonson ..... A63B 23/03525 482/136
5,667,464 A * 9/1997 Simonson ..... A63B 21/4047 482/136
5,800,321 A * 9/1998 Webber ..... A63B 21/0628 482/133
5,997,446 A 12/1999 Stearns
6,056,678 A * 5/2000 Giannelli ..... A63B 23/03525 482/137

(Continued)

OTHER PUBLICATIONS

International Search Report and Written Opinion for PCT/US/2024/057812, date of mailing Feb. 14, 2025, 13 pages.

*Primary Examiner* — Andrew S Lo
(74) *Attorney, Agent, or Firm* — Chambliss, Bahner & Stophel, P.C.; Stephen D. Adams

(57) ABSTRACT

An apparatus for exercising latissimus dorsi muscles ("lats") of a user. The apparatus includes a frame that provides a user space in which the user is located when exercising the lats using the apparatus. A lever having a handle is rotatably mounted to the frame and is rotated with respect to the frame by the user via the handle about a working axis through a working range of motion ("ROM") in a concentric direction starting at a first rotational position and ending at a second rotational position. The lever may be rotated in an eccentric direction that is opposite the concentric direction and ends at the first rotational position. A resistance system may be selectively coupled and decoupled to the lever and the working ROM may be modified with a range selector. The resistance system resists rotation of the lever in the concentric direction.

20 Claims, 12 Drawing Sheets

(56) References Cited

U.S. PATENT DOCUMENTS 6,074,328 A * 6/2000 Johnson ..... A63B 21/4035 482/137
6,302,833 B1 10/2001 Ellis et al.
6,350,219 B1 * 2/2002 Hobson ..... A63B 21/0615 482/137
6,394,937 B1 * 5/2002 Voris ..... A63B 23/1254 482/136
6,802,800 B1 * 10/2004 Hobson ..... A63B 21/4047 482/137
6,913,565 B2 * 7/2005 Mitchell ..... A63B 23/1281 482/142
7,938,760 B1 * 5/2011 Webber ..... A63B 21/15 482/137
8,734,304 B2 * 5/2014 Webber ..... A63B 21/4047 482/94
2002/0037792 A1 * 3/2002 Smith ..... A63B 21/078 482/92
2002/0187882 A1 * 12/2002 Morris ..... A63B 21/4035 482/92
2003/0092540 A1 5/2003 Gillen
2003/0158019 A1 * 8/2003 Giannelli ..... A63B 21/155 482/100
2005/0032611 A1 * 2/2005 Webber ..... A63B 23/1209 482/97
2006/0030461 A1 * 2/2006 Ish, III ..... A63B 21/159 482/99
2006/0100069 A1 5/2006 Dibble et al.
2010/0035729 A1 2/2010 Pandozy
2012/0277070 A1 * 11/2012 Sienna ..... A63B 21/06 482/94
2017/0319905 A1 11/2017 O'Connor
2019/0054346 A1 * 2/2019 Tuononen ..... A63B 24/0087

* cited by examiner

LAT PULLOVER WITH POP PIN ADJUSTMENT

FIELD

This invention relates generally to an improved lat pullover exercise machine that permits selective adjustment of the width of a user space, range of motion, and seating position using spring-loaded pop pins.

BACKGROUND

Many athletes and non-athletes utilize weightlifting or weight training exercises to build strength and/or bulk, to prevent injury, or to improve overall condition and appearance. One such exercise used to work the back muscles, including the latissimus dorsi ("lats"), is known as a chin up. In performing a chin up, the individual grasps a fixed overhead bar or handle in an overhand grip and then pulls himself or herself upward against their bodyweight or against their bodyweight plus added weights. Even if done properly, this exercise may not permit a full range of exercise since the individual may only perform a partial repetition (e.g., pull part way up or stop before the back muscles have contracted fully). This may be the result of a lack of training in proper form, muscle fatigue, lack of strength, etc. Next, when doing a chin up, the resistance provided by gravity is constant, but the human body exhibits a variable natural strength curve over the full range of exercise. In performing a weightlifting exercise, it is preferable to match the resistance or difficulty of the exercise to that strength curve. Consequently, the muscles may not be fully loaded or may be overloaded at various points of the exercise. Next, during a chin up exercise, the hands naturally seek to follow a curved path outward as the body is pulled upward. However, this path cannot be followed during a chin up because the hands are maintained at a fixed distance from the body.

To overcome these difficulties, the lat pulldown machine has been developed to simulate the exercise movements of a chin up. In using a lat pulldown machine, a user generally faces "inwards" towards the machine and grasps an overhead grip bar that is then pulled vertically downwards toward his or her shoulders. A seat and knee pad are mounted to a frame to position the user. A cable connected to the grip bar operably connects the user's arms to a weight stack such that pulling the grip bar causes the weight stack (or a portion thereof) to be lifted and provides resistance to the exercise. The cable may be journaled over a variable radius cam to alter the distance the weight is displaced for a given distance of grip bar movement at a particular point in the range of motion. Consequently, the resistance to the movement of the grip bar can be varied to match the strength curve of the back muscles.

While the lat pulldown machine has solved many problems associated with performing pullups, certain additional advantages are offered that may provide an improved response to exercise. In both the chin-up exercise and the traditional lat pull-down machine, it is difficult to isolate the lats because the user tends to also use the bicep muscles of the arm. One solution is to use a wide hand placement, but this reduces the range of motion through which the lats are worked, because these muscles are already partially contracted in the starting position. Another issue that impacts certain machines, including lat pulldown machines, is the lack of adjustability. For example, the lat pulldown machine typically has only limited capability to adjust for users of various heights, widths, or ranges of flexibility or strength.

What is needed, therefore, is a machine for exercising the latissimus dorsi muscles ("lats") of a user that has an improved ability to isolate the lats and that also allows the user to adjust machine parameters based on their height, width, strength, flexibility, etc.

NOTES ON CONSTRUCTION

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

Terms concerning attachments, coupling and the like, such as "connected" and "interconnected", refer to a relationship wherein structures are secured or attached to one another either directly or indirectly through intervening structures, as well as both moveable and rigid attachments or relationships, unless specified herein or clearly indicated by context. The term "operatively connected" is such an attachment, coupling or connection that allows the pertinent structures to operate as intended by virtue of that relationship.

The use of any and all examples or exemplary language (e.g., "such as" and "preferably") herein is intended merely to better illuminate the invention and the preferred embodiment thereof, and not to place a limitation on the scope of the invention. Nothing in the specification should be construed as indicating any element as essential to the practice of the invention unless so stated with specificity.

The term "selectively" means repeatably, reversibly, and/or at the time and choosing of the user. For example, two components are "selectively" coupled within the meaning of this disclosure when they may be, at the time and option of the user, be repeatedly and reversibly (i.e., non-permanently and without damage) coupled or decoupled from one another.

With reference to FIG. 1, as used herein, the "concentric direction" is movement of limbs of a user 10 in a direction 12 where the user's latissimus dorsi muscles or "lats" (located within dashed circle 14) shorten to produce tension to meet resistance. The "concentric phase" of an exercise is that portion of the exercise where the user's limbs move in the concentric direction 12. On the other hand, the "eccentric direction" is movement of the limbs of the user in a direction 16 opposite the concentric direction, where the lats lengthen. The "eccentric phase" of an exercise is that portion of the exercise where the user's limbs move in the eccentric direction. In FIG. 1, a righthand side of a user 10 is shown. In this image, the concentric direction is movement of the user's arms in a clockwise direction 12, and the eccentric direction is movement of the user's arms in a counterclockwise direction 14. Of course, if the lefthand side of the user were shown instead, movement in the concentric direction would occur when the user's arms moved in a counterclockwise direction, and movement in the eccentric direction would occur when the user's arms moved in a clockwise direction.

SUMMARY

The above and other problems are addressed by an apparatus for exercising latissimus dorsi muscles ("lats") of a user. The apparatus includes a frame that provides a user space in which the user is located when exercising the lats using the apparatus. A lever having a handle is rotatably mounted to the frame. The lever may be rotated with respect to the frame by the user via the handle about a working axis through a working range of motion ("ROM") in a concentric direction starting at a first rotational position and ending at a second rotational position. The lever is further configured to be rotated in an eccentric direction that is opposite the concentric direction and that ends at the first rotational position. The apparatus also includes a resistance system and a range selector. The range selector may be used to selectively couple and decouple the lever with the resistance system and to selectively modify the working ROM. When the lever is coupled to the resistance system via the range selector, the resistance system acts on the lever to provide a resistance force that resists rotation of the lever in the concentric direction. For example, in certain cases, the resistance system is a weight stack providing a plurality of weights that can be selectively activated in order to vary the resistance force.

In certain embodiments, the range selector is configured to modify the working ROM by modifying a location of the first rotational position from a first location that provides a first working ROM to a second location that provides a second working ROM that is different from the first working ROM. Preferably, the range selector includes a multi-position member that is operatively connected to the resistance system and provides a plurality of selectable positions that at least partially surround the working axis and that are each associated with a unique working ROM. Also, a position selector may be used to selectively engage the multi-position member at each of the selectable positions to operatively couple the lever and the resistance system together and to select the working ROM. When the position selector is engaged with the multi-position member, the lever and the multi-position member rotate about the working axis together as a single unit and the resistance system resists rotation in the concentric direction. Engaging the position selector with each selectable position of the plurality of selectable positions provides a unique working ROM. When the position selector is not engaged with the multi-position member, the lever rotates independently of the multi-position member.

In certain embodiment, a common shaft is disposed along and is parallel with the working axis. The multi-position member and the resistance system are preferably attached to and are configured to rotate with the common shaft. Also, the lever is preferably mounted to the frame via the common shaft and is configured to rotate independently about the common shaft when the position selector is not engaged with the multi-position member. The lever is preferably further configured to rotate as a single unit with the common shaft, multi-position member, and resistance system when the position selector is engaged with the multi-position member. In certain instances, the position selector may be rotated with the lever and with respect to the frame about the working axis past the plurality of selectable positions when the position selector is not engaged with the multi-position member. Preferably, end stops are located adjacent opposing ends of the plurality of selectable positions of the multi-position member, wherein each end stop is configured to engage the lever and to prevent the lever from rotating about the working axis beyond the end stop.

In certain cases, the multi-position member is a multi-apertured plate and each of the plurality of selectable positions is located at an aperture formed in the multi-apertured plate. Further, the position selector may be a pin that is configured to separately engage each of the apertures of the multi-apertured plate. More particularly, in certain embodiments, the pin is a spring-loaded pop pin that automatically engages each of the apertures of the multi-apertured plate.

In certain instances, the frame includes a pair of frame arms defining the user space between them and a lever mounting location formed on the frame that is positioned such that one lever mounting location is located on each side of the user when the user is located in the user space. Preferably, the lever includes a working arm that is rotatably joined to the frame at each of the lever mounting locations such that each of the working arms rotates within or about one of said lever mounting locations adjacent each side of the user when the user is located in the user space. Between the handle and the lever mounting location, each working arm is rigid and does not change shape when the lever is moved in the concentric direction or is moved in the eccentric direction. In certain cases, the handle is an EZ curl bar having opposing ends that are each mounted to one of the working arms with bearings such that the EZ curl bar is capable of rotating about a handle axis that extends through the opposing ends of the EZ curl bar. In certain instances, an arm rest on each of the working arms is configured to be contacted by a portion of an arm of the user when the user is located in the user space. The arm rest receives a user force from the user that acts against the resistance force when the lever is moved in the concentric direction.

In certain cases, each arm rest is configured to move laterally with respect to the user space and to be selectively fixed at a selected lateral position. In some cases, a receiver is mounted to each of the working arms and includes an opening extending laterally through the receiver with respect to the user space. Additionally, an elongate portion of each arm rest is slidably received within the opening of one of the receivers such that the elongate portion of the arm rest may slide laterally within the opening to position the arm rest at a plurality of lateral positions. Additionally, a multi-position member is carried by one of the arm rest or the receiver and it provides a plurality of selectable positions that each correspond with a separate lateral position. Also, a position selector is carried by the other one of the arm rest and the receiver and is configured to selectively engage each of the selectable positions of the multi-position member to selectively hold the arm rest at a selected lateral position. In certain cases, the multi-position member includes apertures disposed at two or more lateral positions along the elongate portion. Further, the position selector is a pin that is configured to separately engage each of the apertures disposed along the elongate portion. In certain cases, the pin is a is a spring-loaded pop pin that is configured to automatically engage each of the apertures disposed along the elongate portion.

In certain embodiments, the apparatus includes a seat that is located in the user space. Preferably, the seat includes a bottom support and a lumbar support. The lumbar support may include a bottom end and an opposing top end, and the bottom end of the lumbar support is rotatably mounted to the frame and is configured to rotate forwards and backwards with respect to the frame about a seat axis. Additionally, locking means is provided for fixing the lumbar support at a selected rotational position with respect to the frame. In certain cases, the locking means includes a multi-position member that is carried by one of the frame or the lumbar support. The multi-position member provides a plurality of selectable positions that each correspond with a separate rotational position. Additionally, the locking means also preferably includes a position selector that is carried by the other one of the frame or the lumbar support and that is configured to selectively engage each of the selectable positions to couple the frame and lumbar support together with the lumbar support being oriented at the selected rotational position with respect to the frame. In certain cases, the multi-position member is a multi-apertured plate and each of the plurality of selectable positions is located at an aperture formed in the multi-apertured plate. Additionally, the position selector may be a pin that is configured to separately engage each of the apertures of the multi-apertured plate. In preferred embodiments, the pin is a spring-loaded pop pin that is configured to automatically engage each of the apertures of the multi-apertured plate.

BRIEF DESCRIPTION OF THE DRAWINGS

Further advantages of the invention are apparent by reference to the detailed description when considered in conjunction with the figures, which are not to scale so as to more clearly show the details, wherein like reference numerals represent like elements throughout the several views, and wherein.

DETAILED DESCRIPTION

Figure 1:
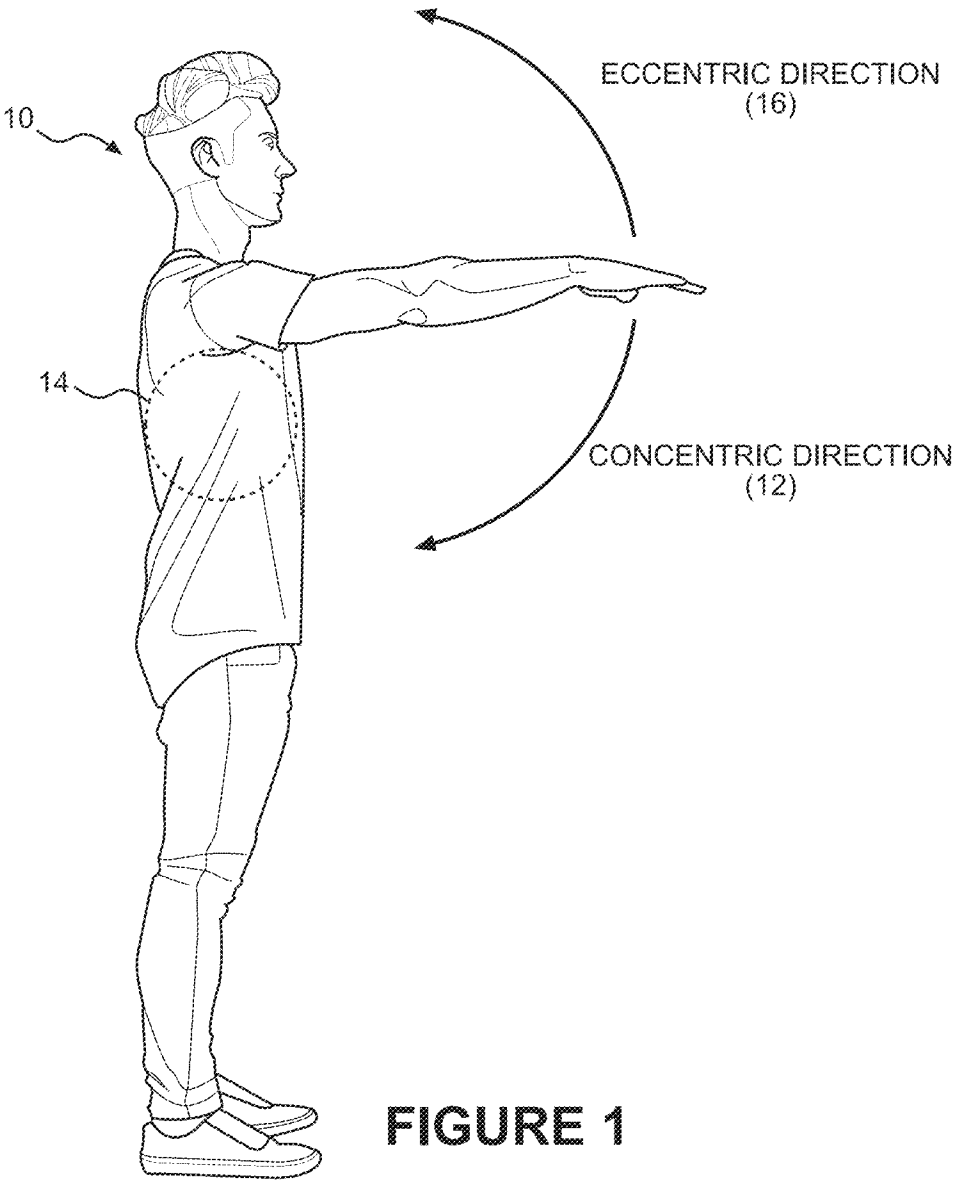
FIG. 1 shows a user and depicts a concentric direction, where movement of limbs of the user causes the user's latissimus dorsi muscles ("lats") to shorten to produce tension to meet resistance and an eccentric direction that is opposite the concentric direction.
Figure 3:
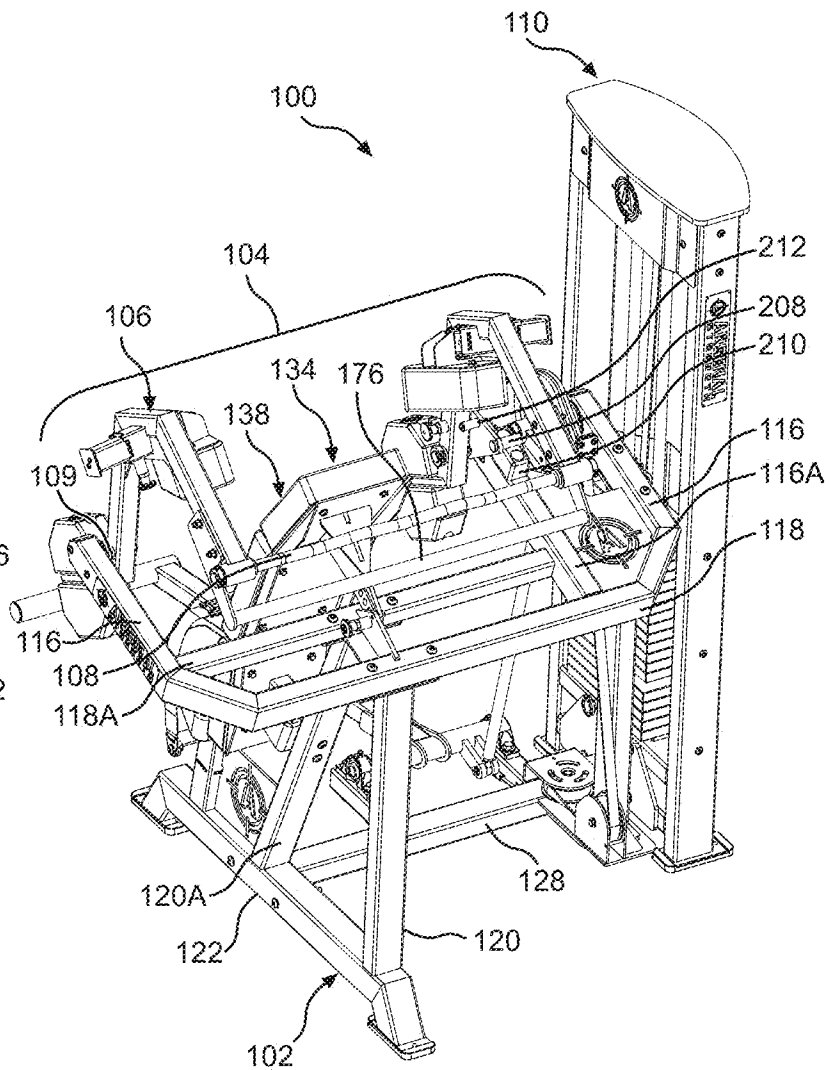
FIG. 3 is a rear perspective view of the apparatus of FIG. 2.
Figure 2:
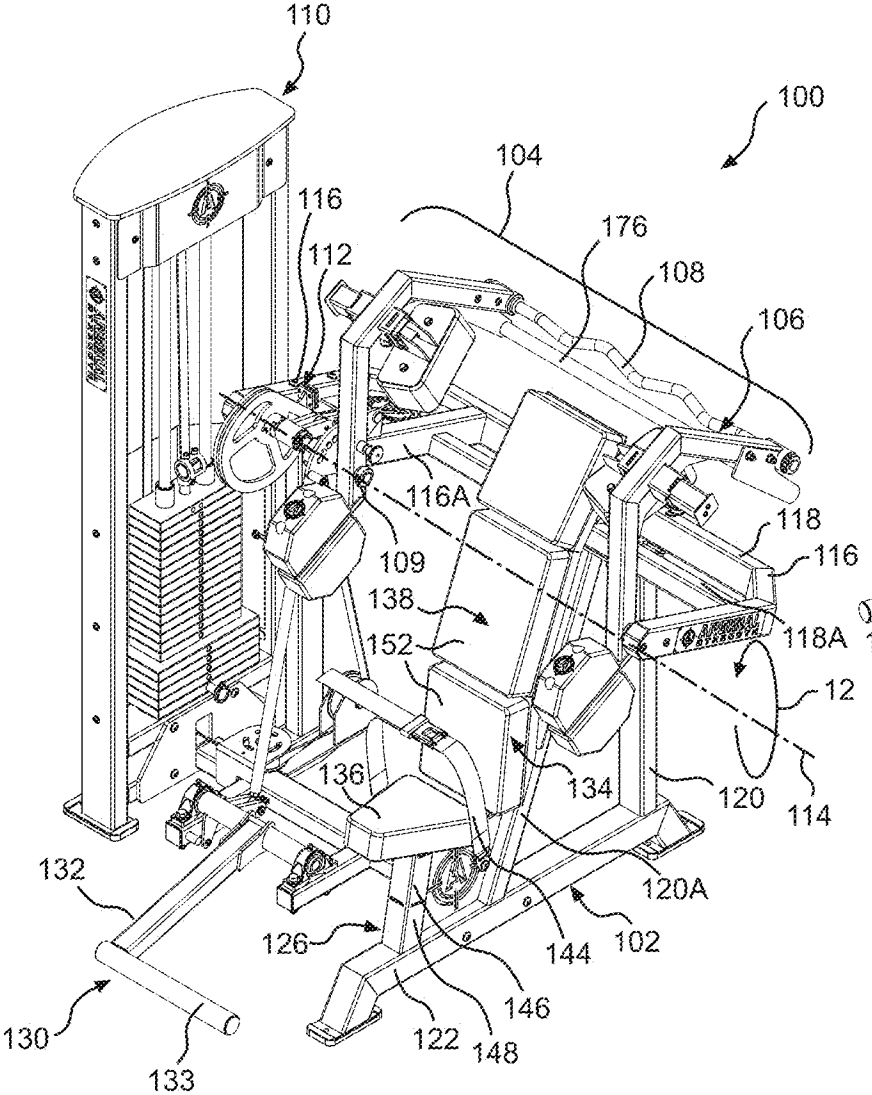
FIG. 2 is a front perspective view of an apparatus having a weight stack for exercising lats of a user according to an embodiment of the present invention.
Figure 4:
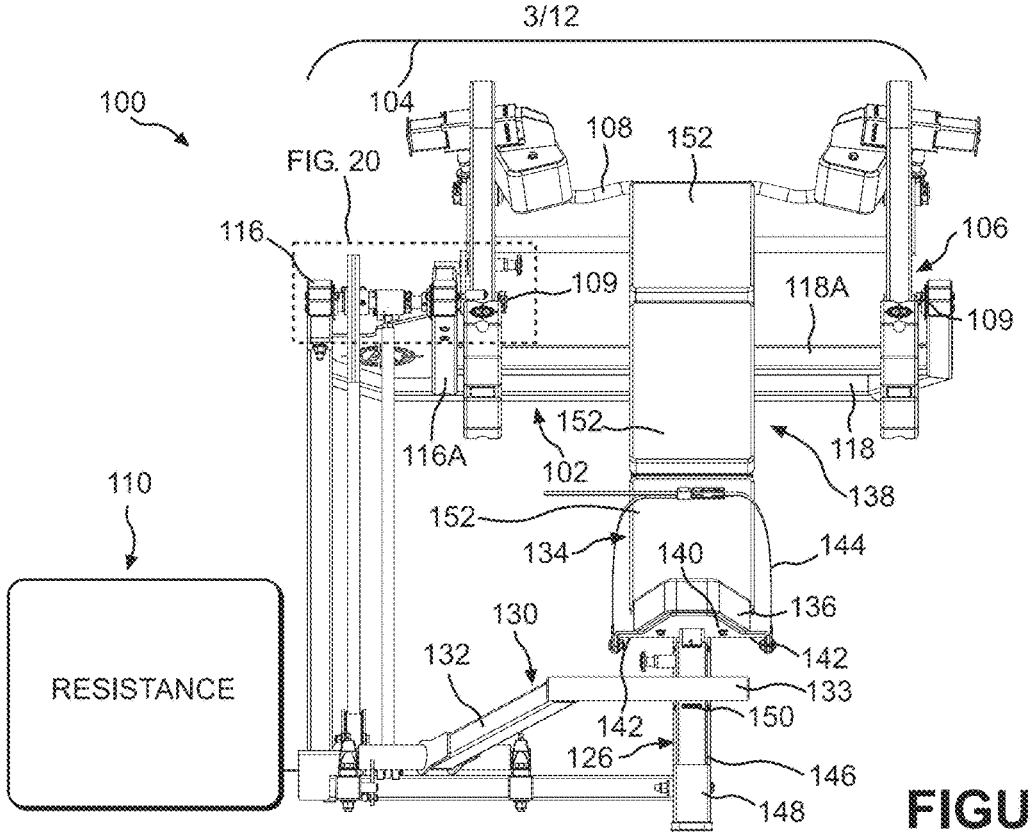
FIG. 4 is a front elevation view depicting the apparatus of FIG. 2 but where the weight stack is replaced with a generic resistance element.
Figure 5:
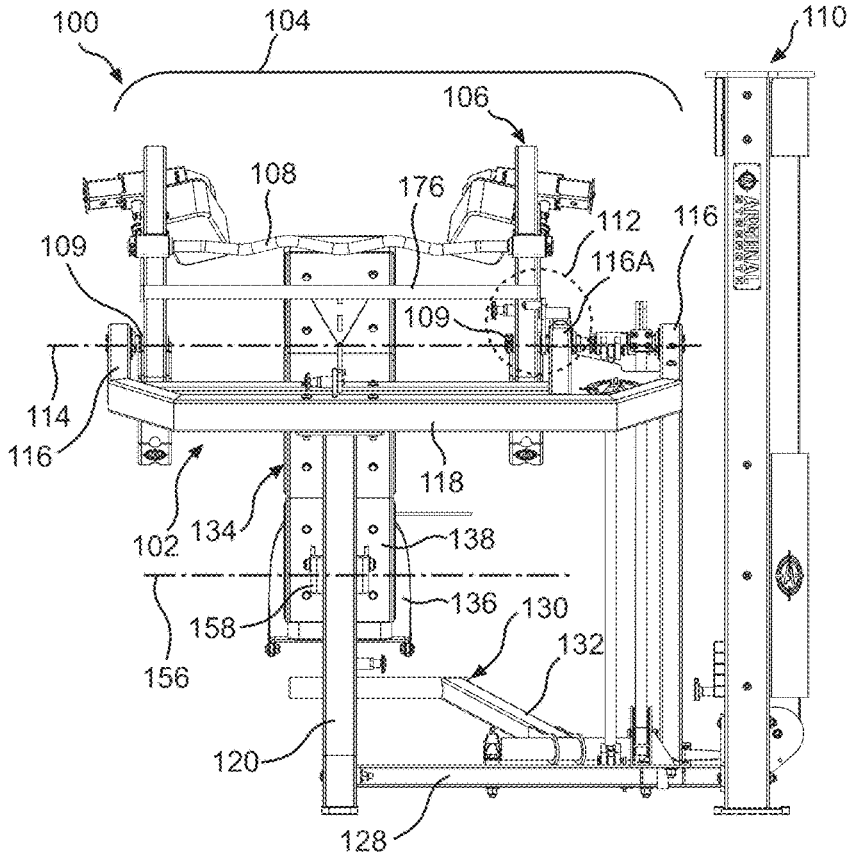
FIG. 5 is a rear elevation view of the apparatus of FIG. 2.
Figure 7:
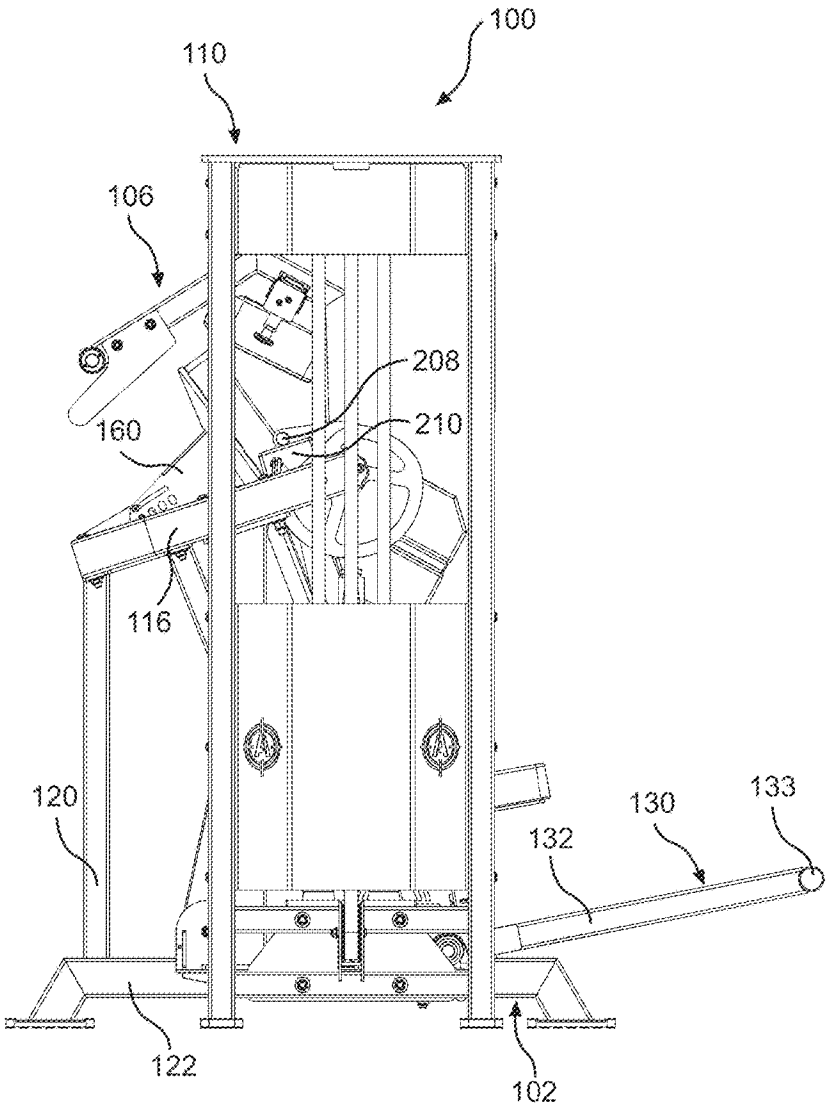
FIGS. 6 and 7 are lefthand and righthand elevation views, respectively, of the apparatus of FIG. 2.
Figure 6:
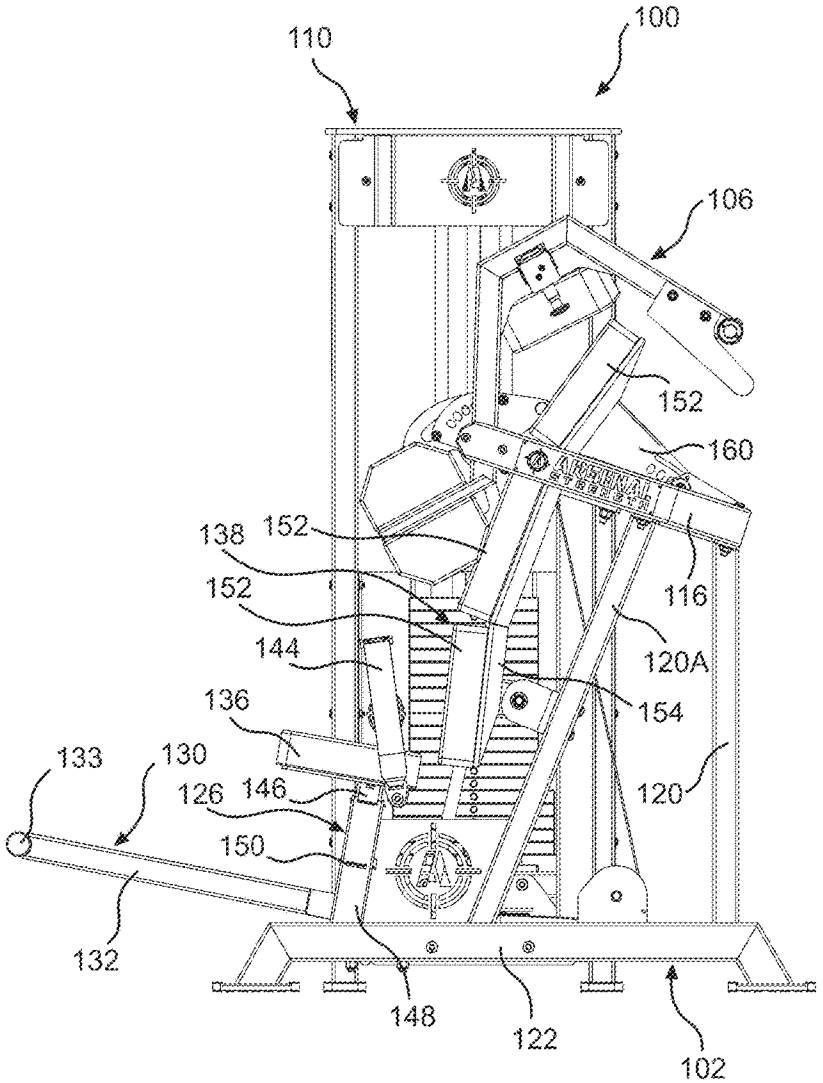
Figure 8:
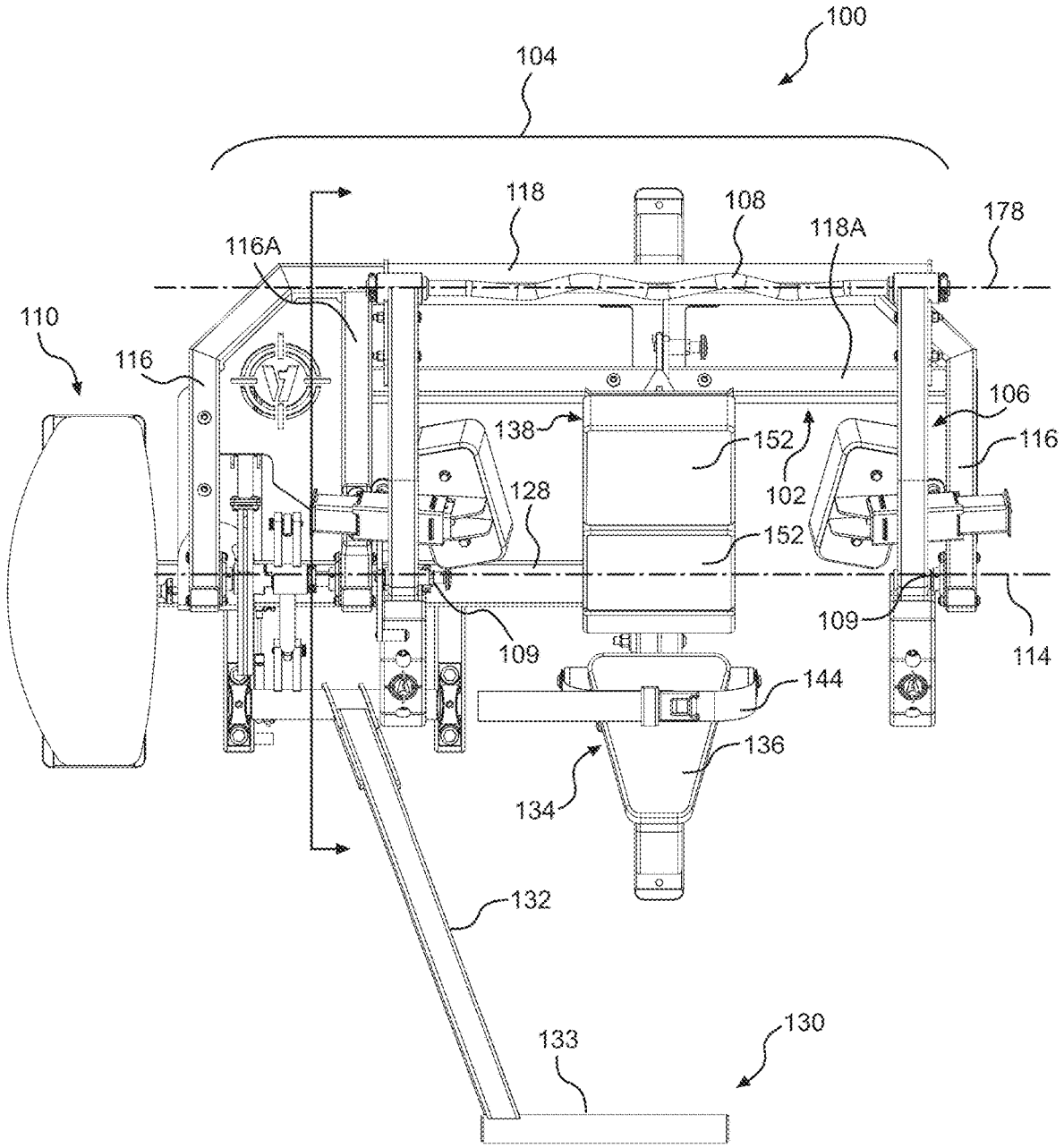
FIG. 8 is a top plan view of the apparatus of FIG. 2.
Figures 9A, 9B, 9C:
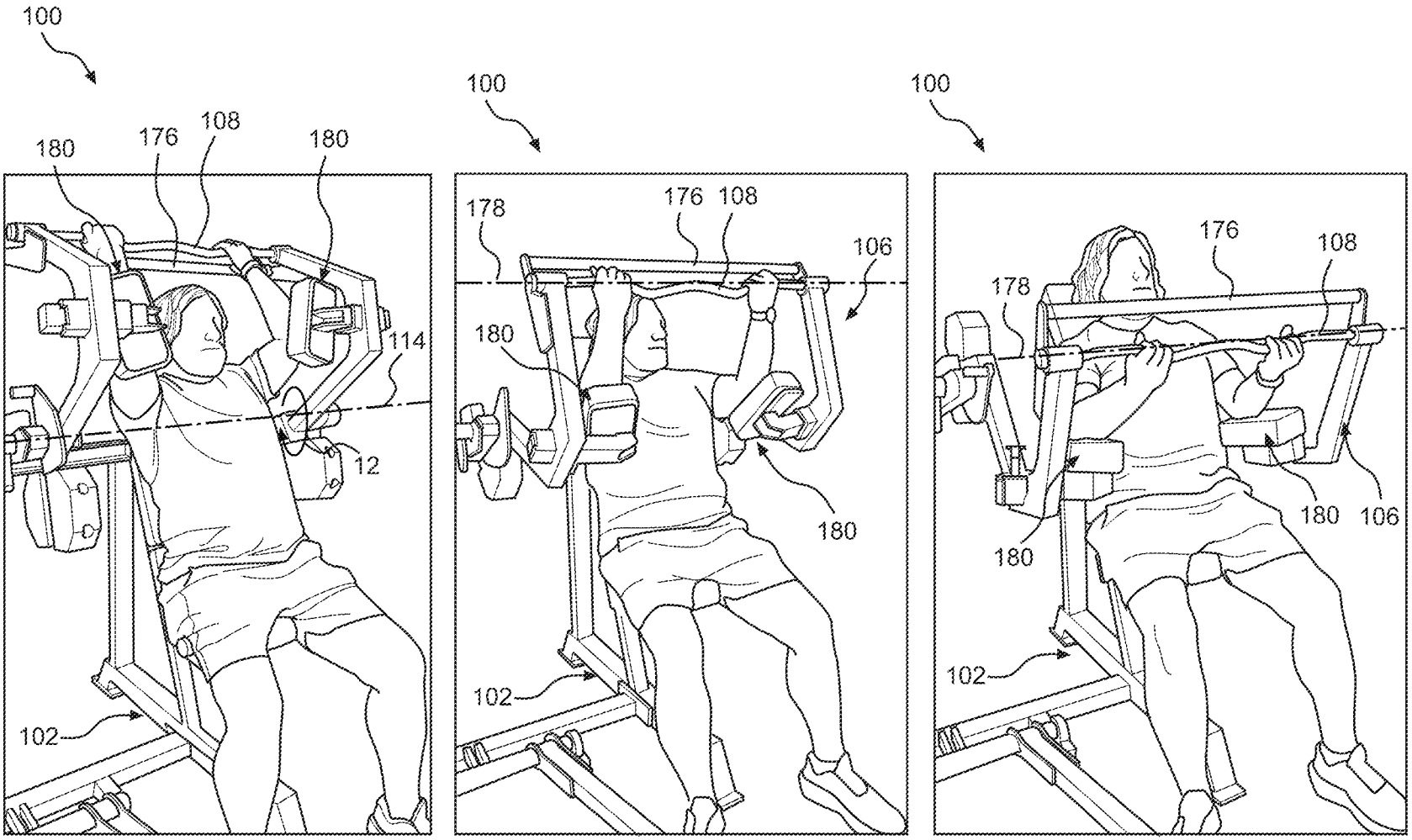
FIGS. 9A thru 9C depict a user performing an exercise using the apparatus of FIG. 2 and moving in a concentric direction from a first rotational position (FIG. 9A), to an intermediate rotational position (FIG. 9B), and then to a second rotational position (FIG. 9C)

Referring now to the drawings in which like reference characters designate like or corresponding characters throughout the several views, there is shown in FIGS. 2-8, an apparatus 100 for exercising latissimus dorsi muscles ("lats") of a user according to an embodiment of the present invention. The apparatus 100 includes a frame 102 providing a user space 104 in which the user is located when exercising the lats using the apparatus. The apparatus 100 also includes a lever 106 having a handle 108 that is rotatably mounted to the frame 102 at a pair of lever mounting locations 109, resistance system 110, and a range selector 112 (see FIG. 5). As shown in FIGS. 9A-9C, when the apparatus 100 is in use, the lever 106 may be rotated with respect to the frame 102 by the user via the handle 108 about a working axis 114 through a working range of motion ("ROM") in the concentric direction 12 starting at a first rotational position (shown in FIG. 9A), through an intermediate rotational position (shown in FIG. 9B), and ending at a second rotational position (shown in FIG. 9C). As described below, when the range selector 112 is engaged, rotation of the lever 106 in the concentric direction 12 is resisted by the resistance system 110. The range selector 112 may also be used to modify the working ROM of exercises performed using the apparatus 100. The lever 106 is also configured to be rotated in an eccentric direction that is opposite the concentric direction 12 and ends at the first rotational position.

When the lever 106 is moved in the concentric direction 12, its motion may optionally be resisted with the resistance system 110. More specifically, when the lever 106 is coupled to the resistance system 110 via the range selector 112, the resistance system acts on the lever to provide a resistance force that resists rotation of the lever in the concentric direction. When the lever is decoupled from the resistance system 110 via the range selector 112, the lever 106 preferably rotates freely without resistance from the resistance system 110. Thus, the resistance system 110 may be selectively activated or deactivated using the range selector 112. In certain embodiments, including the illustrated embodiment, resistance system 110 is a weight stack having a plurality of weights that can be selectively activated in order to vary the resistance force. However, other forms of resistance may be used in place of a weight stack in other embodiments (e.g., plates, bands, magnetic resistance, etc.).

Referring again to FIG. 2-8, the frame 102 includes a pair of frame arms 116 that define the user space 104 between them. In the illustrated embodiment, the arms 116 are connected together by a crossbar 118. The combination of the arms 116 and crossbar 118 are positioned vertically so as to be located at approximately a vertical middle of a user's back by vertical member 120. The vertical member 120 is then supported by bottom support 122 that rests on the ground surface to support the apparatus 100. In the illustrated embodiment the bottom support 122 extends forwards from the vertical member 120 and terminates at a location that is located slightly in front of seat support 126. A lateral bottom member 128 extends laterally from the bottom support 122 and attaches to the resistance system 110. As further discussed below, in certain cases, the apparatus 100 is also provided with a user assist system 130 that is used to assist a user in beginning a lat pullover exercise. In such cases, a foot pedal 133 may be operatively mounted to the resistance system 110 via one or more interconnected linkages 132.

Next, a secondary or inner frame is provided within the user space 104 for supporting a rear portion of seat 134 and for providing a location for mounting the lever 106 to the range selector 112. The inner frame is formed by an inner arm 116A that extends forwards from crossbar 118 and is parallel with arms 116, inner crossbar 118A that is connected between one of arms 116 and inner arm 116A, and inner vertical member 120A that extends upwards from bottom support 122 and is connected to inner crossbar 118A. Unlike vertical member 120, which preferably extends directly upwards (i.e., vertical), inner vertical member 120A extends upwards at an angle to provide a mounting location as well as space for the seat 134. In the illustrated embodiment, inner vertical member 120A is preferably angled between 60° and 80° with respect to the ground surface and bottom support 122. More preferably, inner vertical member 120A is angled at approximately 70° with respect to the ground surface and bottom support 122.

Figure 11:
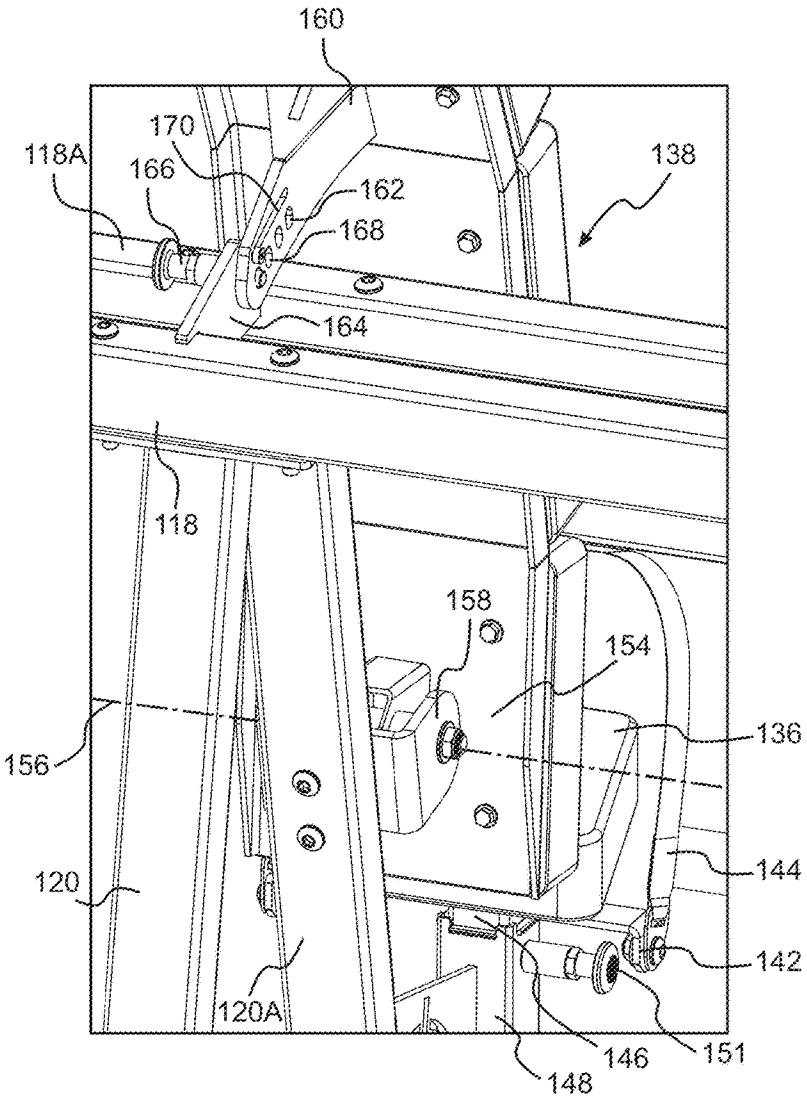
FIG. 11 depicts a rear portion of a seat of the apparatus of FIG. 2 and shows a position selector including a spring-loaded pop pin used for selectively positioning and locking a lumbar support of the seat in a desired rotational position.
Figure 10:
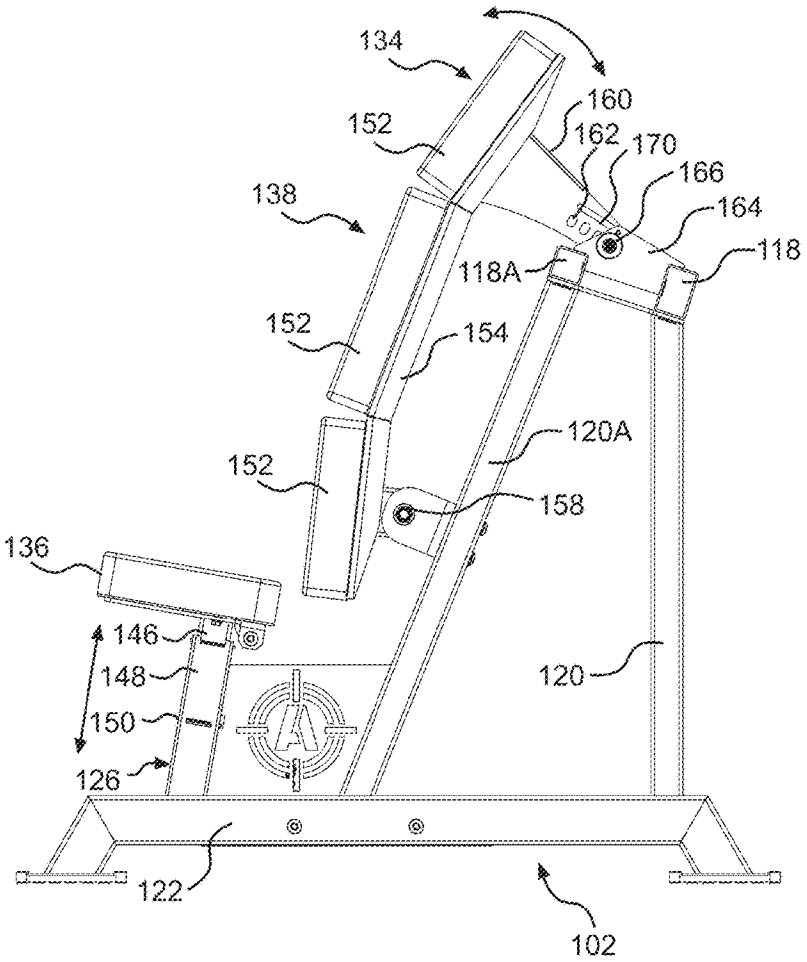
FIG. 10 is a lefthand elevation view of a portion of the apparatus of FIG. 2 illustrating an adjustable seat that is configured to rotate about a lumbar support axis.
Figure 12:
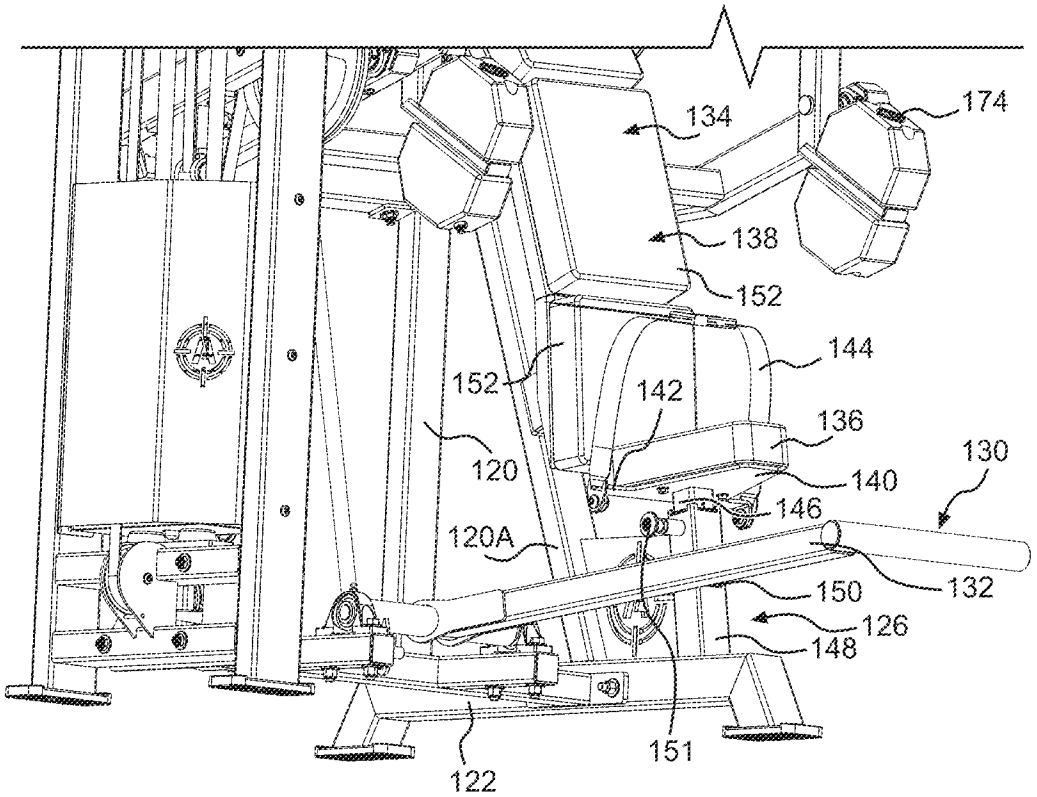
FIG. 12 is a lower front perspective view of the apparatus of FIG. 2.
Figure 13:
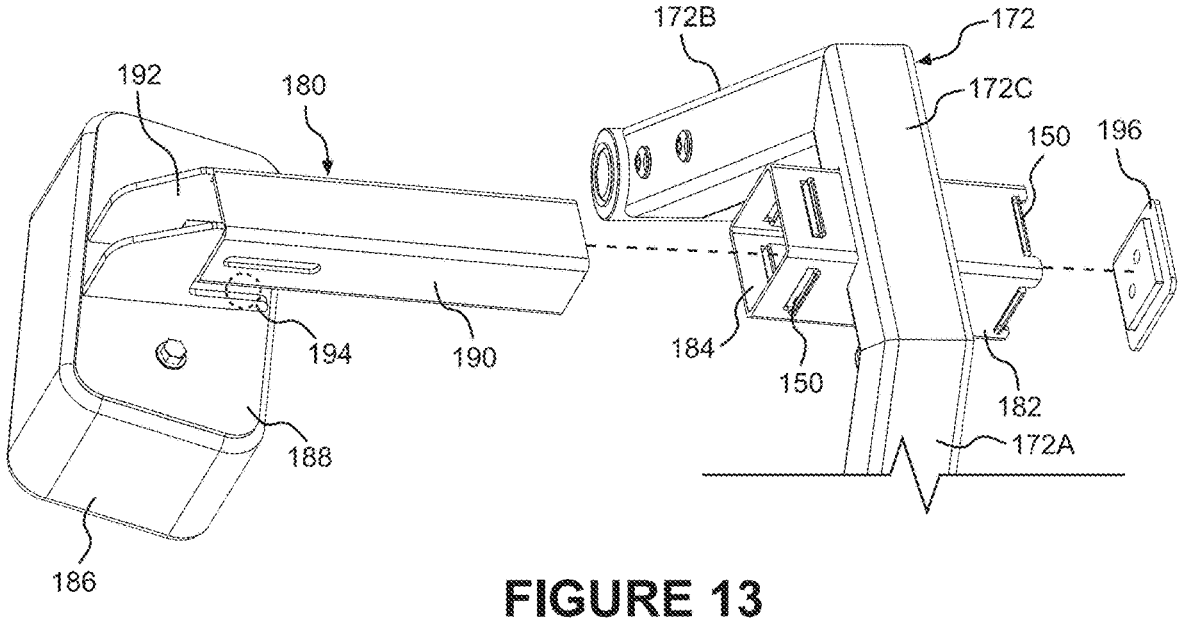
FIG. 13 is a front view of one of two arm rests of the apparatus of FIG. 2, where both arm rests are slidably adjustable in a lateral direction.
Figure 14:
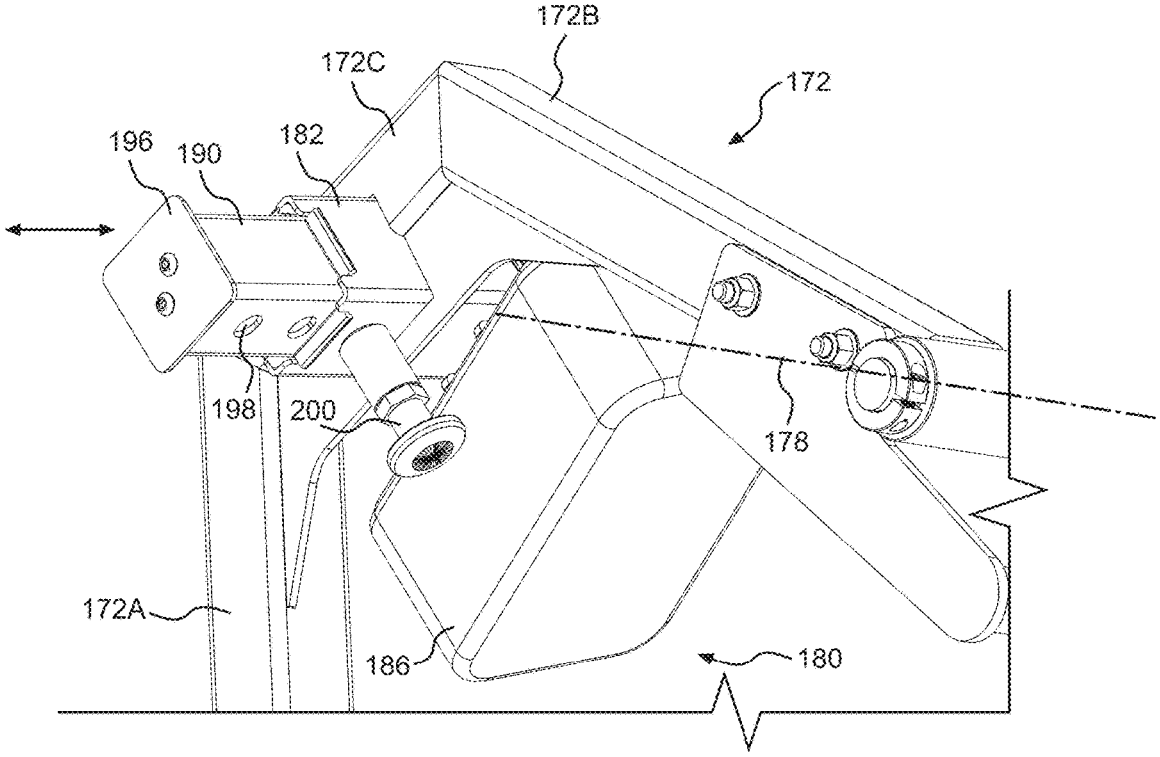
FIG. 14 is a rear view of the arm rest shown in FIG. 13 and that depicts a spring-loaded pop pin used for selectively positioning and locking the arm rest in a desired lateral position.

With reference to FIGS. 10, 11, and 12 angling the inner vertical member 120A in this rearwards manner allows seat 134 to be securely mounted to the inner frame while also providing sufficient clearance to allow the seat to be easily adjustable in a vertical direction and in a front-to-back direction. More particularly, seat 134 preferably includes a bottom support 136 and lumbar support 138, which are each preferably independently movable.

The bottom support 136 of the seat 134 is placed on top of seat support 126, which enables the height of the bottom support to be adjusted in a vertical direction. In preferred embodiments, seat support 126 is formed by a plate 140 that is placed directly below and provides support to bottom support 136. In the illustrated embodiment, plate 140 includes a pair of lugs 142 that extend laterally outward away from the plate 140 to either side of seat 134 and that provide mounting locations for attaching a seat belt 144. The seat support 126 also includes an elongate portion 146 having a top that is mounted to a lower surface of the plate 140 and a receiver 148 having a top opening (not shown) that slidably receives the elongate portion of the seat support. In preferred embodiments, one or more low-friction slider inserts 150, such as those described in U.S. Pat. No. 11,278,757, are placed between the elongate portion 146 and receiver 148 to facilitate the sliding movement of the elongate portion within the receiver. Finally, seat support 126 preferably includes a locking means for securing the bottom support 136 at a selected vertical position. In the illustrated case, a series of apertures (not shown) are provided in the elongate portion 146 of the seat support and a pin, such as spring-loaded pop pin 151, is placed on receiver 148 and is configured to selected engage each of the apertures in order to hold the bottom support 136 at a selected height.

Next, lumbar support 138 is preferably formed by one or more lumbar sections 152 that are rigidly mounted together via a back support 154 and are arranged so as to provide a slight rearward curve. Further, lumbar support 138 is rotatably mounted to the frame 102 to allow an upper end of the lumbar support to be pivoted forward and backward about a seat axis 156 (FIG. 11) to support the user in a selected vertical position. Preferably, the back support 154 of lumbar support 138 that supports lumbar sections 152 can be positioned between approximately 60° and approximately 80° with respect to the ground surface. In the illustrated embodiment, a lower rotating mount 158 connects a bottom end of the back support 154 to the inner vertical member 120A, and the seat axis 156 passes through the lower rotating mount.

Next, a locking means is provided for fixing the lumbar support 138 at a selected rotational position with respect to the frame 102. The locking means may include a multi-position member that works cooperatively with a position selector. One of these components of the locking means is preferably carried by one of the frame 102 or the lumbar support 138, while the other component is mounted to the other one of the frame and lumbar support. Preferably, the multi-position member provides a plurality of selectable positions that each correspond with a separate rotational position and, therefore, a different vertical orientation for the lumbar support 138. The position selector is configured to selectively engage each of the selectable positions to couple the frame 102 and lumbar support 138 together with the lumbar support being oriented at the selected rotational position with respect to the frame. In the illustrated embodiment, the multi-position member is a multi-apertured plate 160 having a plurality of apertures 162 that each correspond with a different rotational position and, thus, a different vertical orientation for the lumbar support. The multi-apertured plate 160 is mounted to the back support 154. In the illustrated embodiment, the position selector includes a plate 164 that is fixedly attached to the crossbar 118 and the inner crossbar 118A. A first pin 166 and a second pin 168 are preferably mounted to the plate 164. The first pin 166 is configured to engage each of the apertures 162 of the multi-apertured plate 160. Preferably, the first pin 164 is a spring-loaded pop pin that, as the lumbar support 138 is moved forward and backward, is configured to automatically engage the apertures of the multi-apertured plate 160 and to couple the frame 102 and lumbar support together with the lumbar support being oriented at the selected rotational position with respect to the frame. On the other hand, the second pin 166 is preferably fixedly but slidably inserted into a continuous and curved slot 170 that is provided in the multi-apertured plate 160. The curved slot 170 is sized and configured to follow the travel path of the lumbar support 138 as it pivots about the lower rotating mount 158. The engagement between the second pin 168 and the slot 170 preferably prevents the two plates 160, 164 from separating from one another.

Now, as shown best in FIGS. 13-19, the lever 106 is configured to rotate in a concentric direction 12 (and eccentric direction) via lever mounting location 109 about working axis 114 between a first rotational position (FIG. 9A) and a second rotational position (FIG. 9C). The lever 106 includes a working arm 172 that, in the illustrated embodiment, is somewhat "C" shaped and imitates the general shape of a user's arm when the arm is held in a bent position. Preferably, to limit activation of the bicep while using the apparatus 100, at least the portion of each working arm 172 between the handle 108 and the lever mounting location 109 is rigid and does not change shape when the lever is moved in the concentric direction or is moved in the eccentric direction. Thus, advantageously, use of the working arm 172 to operate the apparatus 100 forces the user to hold his or her arms in the desired bent position that tends to isolate the lats and to reduce or eliminate use of the biceps to perform the lat pullover exercise.

The working arm 172 includes a first end 172A that is rotatably mounted in the user space 104 between the frame arms 116. Counterweights 174 are preferably also located at the first end 172A of the working arm 172 to automatically bias the lever 106 to the first rotational position when the apparatus 100 is not in use. Next, the working arm 172 also provides a second end 172B where the user handle 108 and a handle crossbar 176 are located. The handle crossbar 176 is preferably fixedly connected between the second end 172B of the working arms 172 for providing structural support and rigidity to the lever 106. As shown best in FIGS. 16 and 17, the first end 172A and second end 172B are oriented at a similar or identical (but mirrored) angle to one another with respect to the middle portion 172C. The middle portion 172C is located between and rigidly connects the first end 172A and the second end 172B together. In the illustrated embodiment, a similar angle of approximately 120° is formed between the middle portion 172C and each of the first end 172A and the second end 172B.

When the apparatus 100 is in use, the user's upper arm (e.g., including his or her biceps) ideally extends substantially parallel with the first end 172A, which is preferably sized to approximate the length of users' upper arm. Similarly, the user's forearm ideally extends substantially parallel with the second end 172B, which is preferably sized to approximate the length of users' forearm and approximates the length of the first end 172A. The handle 108 is grasped by the user and is used to rotate the lever 106. The lever mounting location 109 and the working axis 114 are ideally located at approximately the user's shoulders such that the user's arms substantially rotate about the working axis while using the apparatus 100. In certain embodiments, a separate handle 108 is attached to each working arm 172. In other embodiments, a single handle 108 is connected between the working arms 172. In preferred embodiments, including the illustrated embodiment, the single handle 108 is EZ curl bar having opposing ends that are each mounted to one of the working arms 172 via bearings such that the EZ curl bar is capable of freely rotating about a handle axis 178 (FIG. 14) that extends through the opposing ends of the EZ curl bar. Next, the user's elbow is position at the middle portion 172C, which is preferably sized to be shorter than the first end 172A and second end 172B. Ideally, to target the lats, the lever 106 is rotated in the concentric direction by directing a force through the middle portion 172C by drawing the elbow downwards around the body (see FIGS. 9A-9C). Thus, preferably, a padded arm rest 180 is provided on each of the working arms 172. Each arm rest 180 is configured to be contacted by a portion of an arm of the user when the user is located in the user space 104 and to receive a user force from the user that acts against the resistance force when the lever is moved in the concentric direction.

Next, preferably, each arm rest 180 is configured to move laterally with respect to the working arm 172 and user space (not shown) and to be selectively fixed at a selected lateral position. This lateral adjustment of the arm rests 180 permits the lateral width of the user space 104 to be selectively increased and decreased to accommodate users of varying sizes. For example, for individuals that are particularly large, an outward adjustment of the arm rests 172 preferably prevents the lever 106 from making unwanted contact with that user. Similarly, for small individuals, an inward adjustment of the arm rests 172 preferably allows those individuals to use the apparatus 100 more easily.

In preferred embodiments, each middle portion 172C of the working arms 172 is provided with a receiver 182 that includes an opening 184 (FIG. 13) that extends laterally through the receiver with respect to the user space 104 and that may also be provided with one or more low-friction slider inserts 150. Next, each arm rest 180 also preferably includes a pad 186 that is mounted on a plate 188. Each arm rest 180 also includes an elongate portion 190 that is attached to the plate 188 by an L-shaped bracket 192. As shown best in FIG. 13, the elongate portion 190 is spaced slightly away from the plate 188 by L-shaped bracket 192 to provide a free space therebetween (a portion of which is enclosed by dashed circle 194). The elongate portion 190 is slidably received within the opening 184 of the receiver 182 and is then secured by end plate 196 that is preferably larger than the opening such that the elongate portion cannot be accidentally extracted from the receiver. The elongate portion 190 is configured to slide laterally within the receiver 182 to position the arm rest 180 and pad 186 at a plurality of lateral positions. In the illustrated embodiment, lateral movement of the arm rest 180 in an inwards direction (i.e., towards user space 104) is limited when end plate 196 contacts receiver 182. Conversely, lateral movement of the arm rest 180 in an outwards direction (i.e., away from user space 104) is limited when receiver 182 passes into free space 194 and then contacts L-shaped bracket 192.

Next, preferably a multi-position member is carried by one of the arm rest 180 or the receiver 182 and provides a plurality of selectable positions that each correspond with a separate lateral position. Additionally, a position selector is carried by the other one of the arm rest 180 and the receiver 182. The position selector is configured to selectively engage each of the selectable positions of the multi-position member to selectively hold the arm rest 180 at a selected lateral position. In the illustrated embodiment, the multi-position member includes apertures 198 that are located at two or more lateral positions along the elongate portion 190 of the arm rest 180. Next, in the illustrated embodiment, the position selector is a pin 200 that is configured to separately and selectively engage each of the apertures 198 disposed along the elongate portion 190. Preferably, the pin 200 is a is a spring-loaded pop pin that automatically engages each of the apertures 198 disposed along the elongate portion 190.

Next, with reference to FIGS. 15-19, in the illustrated embodiment, the range selector 112 includes a multi-position member 202 and a position selector 204 that works cooperatively with the multi-position member. The multi-position member 202 is operatively connected to the resistance system 110 and provides a plurality of selectable positions 206 that, in certain preferred embodiments, at least partially surround the working axis 114 and that are each associated with a unique working ROM. In the illustrated embodiment, a stop pin 208 is provided on the multi-position member 202 and a corresponding bumper 210 that works cooperatively with the stop pin is provided on inner arm 116A.

Figure 15:
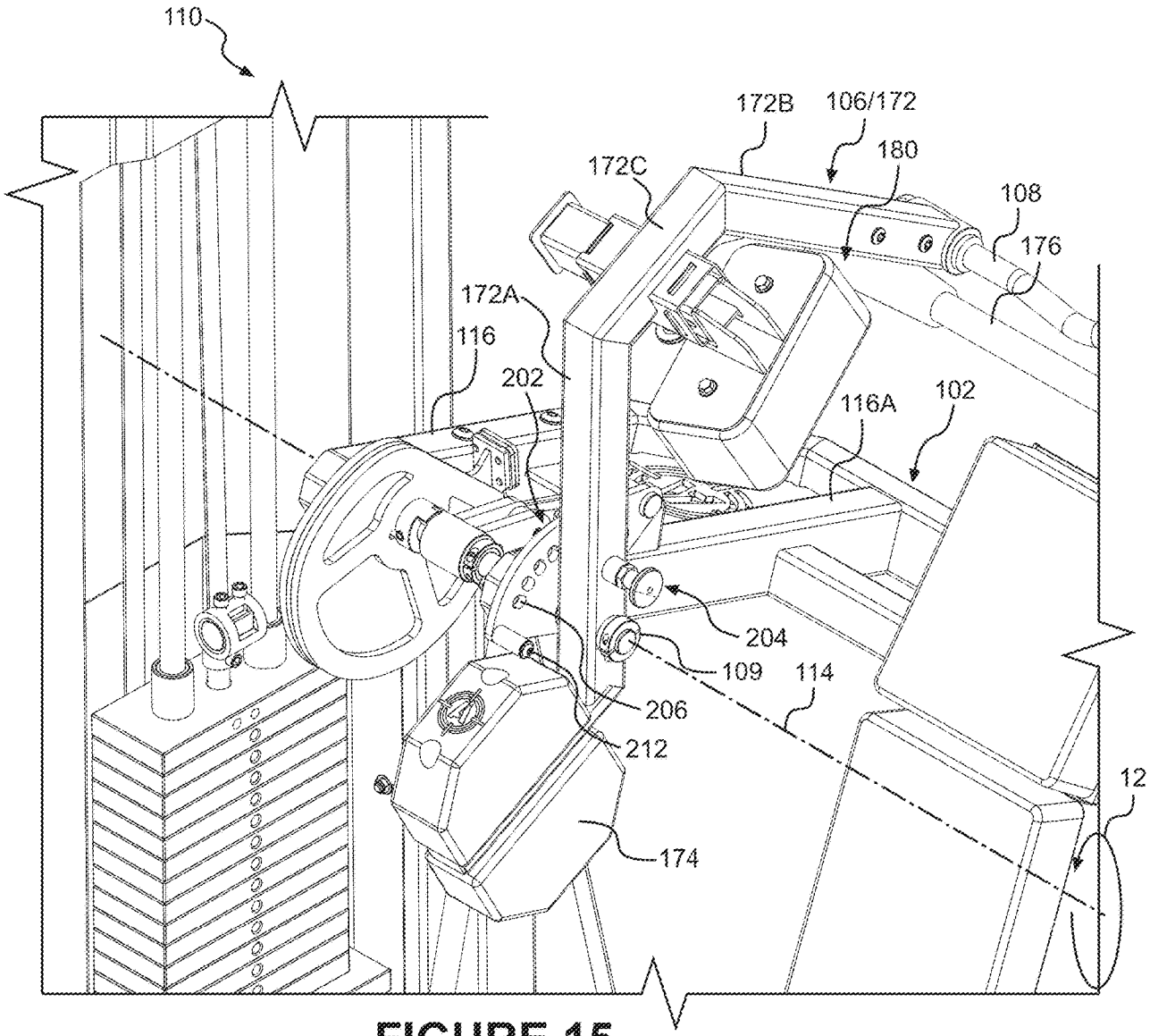
FIG. 15 is a front perspective view of a portion of the apparatus of FIG. 2 and illustrating a range selector having a spring-loaded pop pin used for selectively positioning and locking a lever in a selected rotational position with respect to a resistance system of the apparatus.

The position selector 204 is preferably configured to selectively engage the multi-position member 202 at each of the selectable positions 206 to operatively couple the lever 106 and the resistance system 110 together. When the position selector 204 is disengaged from the multi-position member 202, the lever 106 rotates with respect to the frame 102 and independently of the multi-position member. The apparatus 100 preferably includes a pair of end stops 212 (one of which is shown in FIG. 15) that are located adjacent opposing ends of the plurality of selectable positions 206. When the position selector 204 is disengaged from the multi-position member 202 and the lever 106 can rotate freely, as described above, the end stops 208 engage the lever 106 and prevent it from rotating about the working axis 114 beyond the end stop.

On other hand, when the position selector 204 is engaged with the multi-position member 202, the working ROM of the apparatus 100 can be selectively increased and decreased. The position selector 204 may be positioned between the end stops 208 and then selectively engaged with the multi-position member 202 at each selectable position of the plurality of selectable positions 206 in order to provide a unique working ROM. In preferred embodiments, the multi-position member 202 is a multi-apertured plate that includes stop pin 208 that extends outwardly from the multi-apertured plate. Further, a ring (or a partial ring) of apertures formed in the multi-apertured plate 202 and surrounding the working axis 114 form the plurality of selectable positions 206. Next, the position selector 204 is a pin that is configured to separately engage each of the apertures 206 formed in the multi-apertured plate 202. More preferably, the pin 204 is a spring-loaded pop pin that is configured to automatically engage each of the apertures 206 of the multi-apertured plate 202. End stops 208 are located on either end of the ring of apertures.

After being engaged with one of the selectable positions 206, the position selector 204 (i.e., the spring-loaded pop pin) preferably rotates, as a unit, with the lever 106 and multi-position member 202 (i.e., multi-apertured plate) with respect to the frame 102 about the working axis 114. Rotation of the lever 106 in the eccentric direction is preferably arrested when the stop pin 208 contacts bumper 210. The first rotational position is located where the stop pin 208 contacts bumper 210. Thus, by increasing or decreasing the amount of rotation of the lever 106 that is needed for the stop pin 208 to contact the bumper 210, the working ROM may be increased or decreased. As noted above, counterweights 174 bias the lever 106 in the eccentric direction to the first rotational position. This bias may be overcome by a user applying a force to the lever 106 via the arm rests 180 in the concentric direction.

Figure 17:
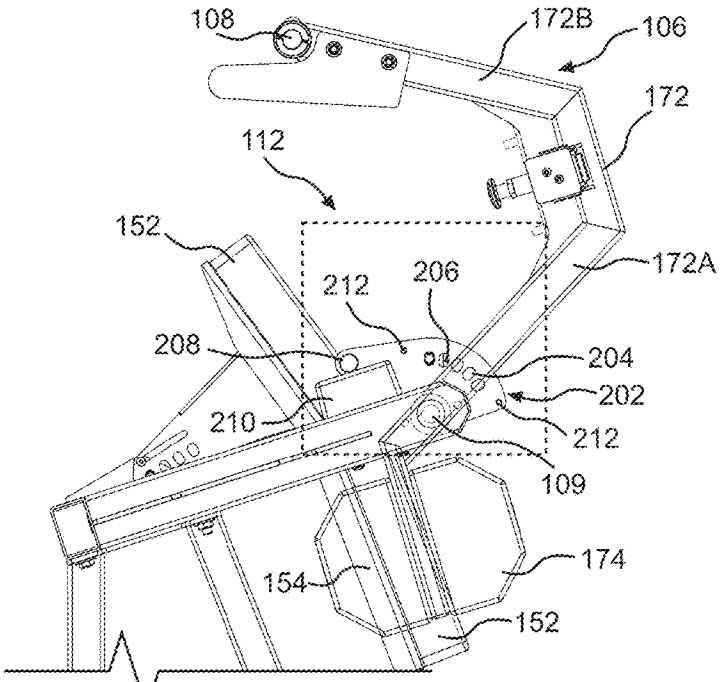
FIG. 17 shows the portion of the apparatus of FIG. 16 where the lever is positioned and locked in a second rotational position with respect to the resistance system of the apparatus to provide a second working ROM.
Figure 19:
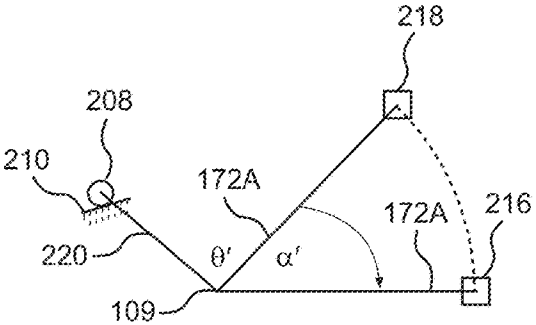
FIG. 19 is a diagrammatic view of the apparatus of FIG. 17 that depicts the second working ROM (B)
Figure 16:
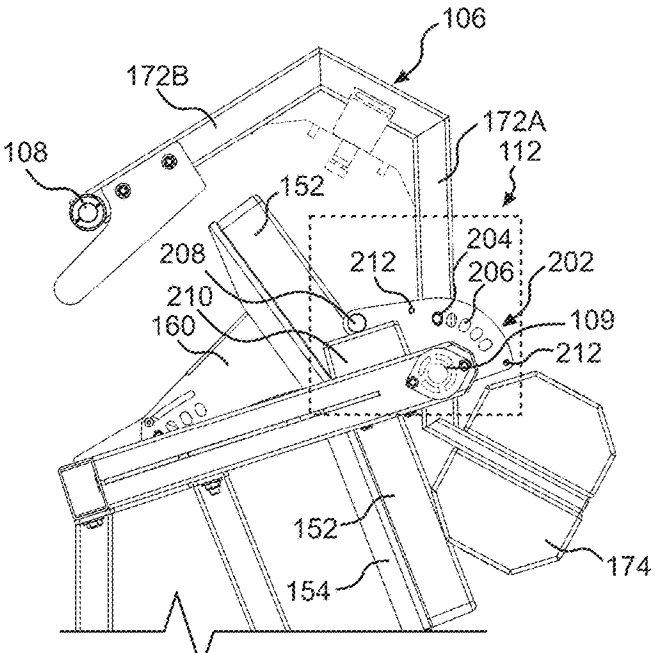
FIG. 16 is a righthand elevation view depicting a portion of the apparatus of FIG. 2 and showing a lever positioned and locked in a first rotational position with respect to the resistance system of the apparatus to provide a first working range of motion (ROM)
Figure 18:
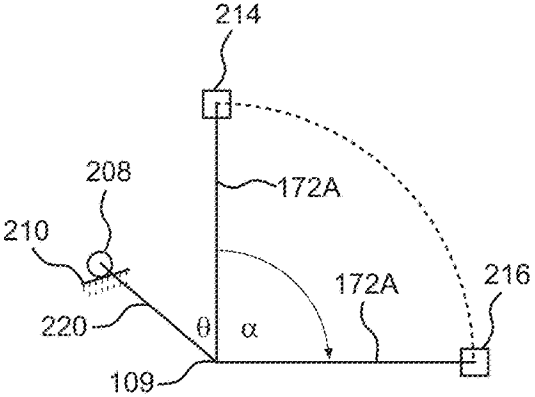
FIG. 18 is a diagrammatic view of the apparatus of FIG. 16 that depicts the first working ROM (a)

FIGS. 18 and 19 are diagrammatic representations of a portion of the apparatus enclosed by dashed lines in FIGS. 16 and 17, respectively, where each figure shows a first end 172A of work arm of the apparatus rotating about lever mounting location 109 through a different working ROM. In FIG. 18, the first end 172A of the working arm moves through a first working ROM that begins at first starting position 214 and ends at stopping position 216. The first working ROM is represented by an angle $\alpha$ that is approximately 90°. On the other hand, in FIG. 19, the first end 172A of the working arm moves through a second working ROM that begins at second starting position 218 and ends at stopping position 216. The second working ROM is represented by an angle $\alpha'$ that is approximately 45°.

As shown, the working ROM is determined based on the distance (or angle) that the first end 172A is permitted to travel. As noted above, travel of the working arm, including the first end 172A, in the eccentric direction is arrested when the stop pin 208 contacts bumper 210. Travel in the concentric direction may also be physically arrested by a similar structure. However, preferably, no such structure is provided. Instead, the user determines the travel distance in the concentric direction based on their size, flexibility, strength, etc. Typically, movement in the concentric direction stops when lats are fully contracted, which generally occurs when the first end 172A is oriented approximately horizontally to the floor surface or straight outwards from the user, as shown in FIGS. 18 and 19.

In these figures, line 220 extends between the point at which stop pin 208 contacts bumper 210 and the rotational center (i.e., lever mounting location 109). In FIG. 18, an angle $\theta$ is formed between line 220 and the first end 172A of the working arm in the first rotational position. Once position selector 204 is engaged with the multi-position member 202 at a selected position (i.e. at a selected aperture in multi-apertured plate), angle $\theta$ is fixed and the position of line 220 relative to the first end 172A is also fixed. This angle $\theta$ determines the working ROM. As $\theta$ increases, the working ROM decreases. For example, in FIG. 18, angle $\theta$ is approximately 45° and the first working ROM, represented by angle $\alpha$, is approximately 90°. On the other hand, as shown in FIG. 19, by selecting a different aperture in the multi-apertured plate 202, the orientation of first end 172A is changed and angle $\theta'$, which is approximately 90°, is provided between line 220 and first end 172A. As a consequence of a larger angle $\theta'$, the resulting second working ROM, represented by angle $\alpha'$ is reduced to approximately 45°.

Figure 20:
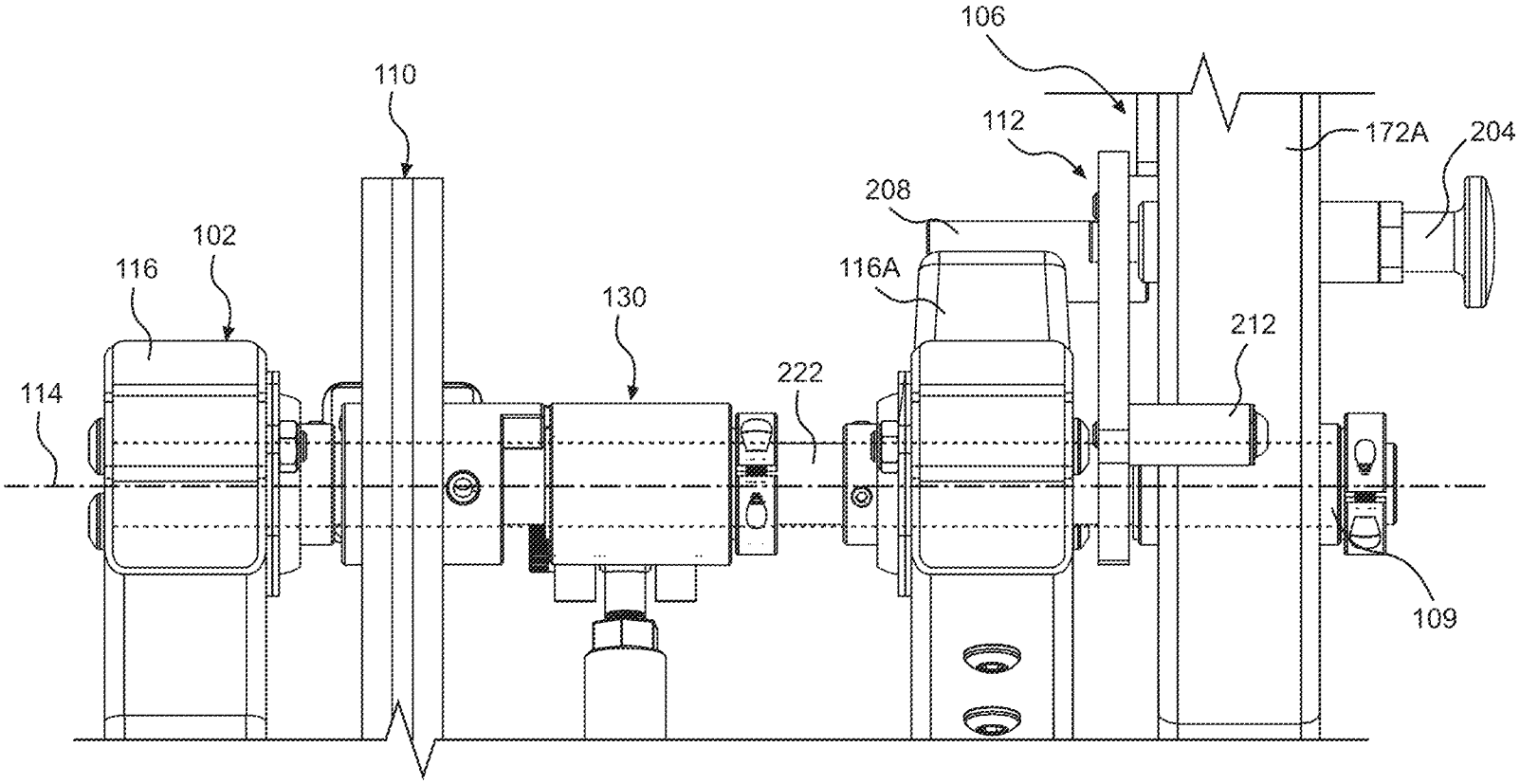
FIG. 20 is a detail view showing a portion of the apparatus of FIG. 4 enclosed by a box identify by "FIG. 20."

Finally, as shown best in FIG. 20, one or both sides of the frame 106 may include a cam pivot rod or common shaft 222. Common shaft 222 that preferably connects one or more of the frame 102, lever 106, resistance system 110, range selector 112, and user assist system 130 together. The common shaft 222 is disposed along (i.e., colinear with) and is parallel to the working axis 114. In the illustrated embodiment, the common shaft 222 is rotatably supported between frame arm 116 and inner arm 116A via bushings, bearings, or the like. Additionally, the lever 106 is selectively rotatably supported on the common shaft 222 such that it may, in certain configurations, rotate with the common shaft or, in other configurations, remain stationary while the common shaft is rotated, or rotate while the common shaft remains stationary. For example, the lever 106 may be mounted to the common shaft 222 at the mounting location 109 via a bushing, bearing, or other similar device that would allow the lever to rotate around the common shaft when the position selector 204 is disengaged from the multi-position member 202. On the other hand, the multi-apertured plate 202 is preferably fixedly attached to the common shaft 222, such as by a welded connection. Thus, in such instances, rotation of the multi-apertured plate 202 about axis 114 also results in a corresponding rotation of the common shaft 222. Likewise, a portion of each of the resistance system 110 and the user assist system 130 is preferably fixedly attached to the common shaft 222 and, therefore, rotates with the rotation of the shaft. As discussed above, engaging the position selector 204 and the lever 106 together with the multi-position member 202 locks them together as a unit such that rotation of the lever would result in the rotation of the common shaft 222. Thus, engaging the position selector 204 with the multi-position member 202 also connects the motion of the lever 106 to the resistance system 110, which resists motion of the lever in the concentric direction. Additionally, the common shaft 222 may be rotated using user assist system 130.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations as would be appreciated by those having ordinary skill in the art to which the invention relates.

What is claimed is:

1. An apparatus for exercising latissimus dorsi muscles ("lats") of a user, the apparatus comprising:

a frame providing a user space in which the user is located when exercising the lats using the apparatus;

a lever having a handle and rotatably mounted to the frame, the lever configured to be rotated with respect to the frame by the user via the handle about a working axis through a working range of motion ("ROM") in a concentric direction starting at a first rotational position and ending at a second rotational position and configured to be rotated in an eccentric direction that is opposite the concentric direction and ends at the first rotational position, wherein the lever includes a rigid working arm configured to force an arm of the user to maintain a substantially constant angle between a forearm and an upper arm of the user throughout the working ROM to isolate the lats;

a resistance system;

a range selector configured to selectively couple and decouple the lever with the resistance system and to selectively modify the working ROM;

wherein, when the lever is coupled to the resistance system via the range selector, the resistance system acts on the lever to provide a resistance force that resists rotation of the lever in the concentric direction.

2. The apparatus of claim 1 wherein the range selector comprises:

a multi-position member that is operatively connected to the resistance system and that provides a plurality of selectable positions that at least partially surround the working axis and that are each associated with a unique working ROM; and a position selector that is configured to selectively engage the multi-position member at each of the selectable positions to operatively couple the lever and the resistance system together and to select the working ROM, wherein, when the position selector is engaged with the multi-position member, the lever and the multi-position member rotate about the working axis together as a single unit and the resistance system resists rotation in the concentric direction, wherein, engaging the position selector with each selectable position of the plurality of selectable positions provides a unique working ROM, wherein, when the position selector is not engaged with the multi-position member, the lever rotates independently of the multi-position member.

3. The apparatus of claim 2 further comprising a common shaft that is disposed along and parallel with the working axis, wherein:

the multi-position member and the resistance system are attached to and are configured to rotate with the common shaft, and the lever is mounted to the frame via the common shaft and is configured to rotate independently about the common shaft when the position selector is not engaged with the multi-position member, and the lever is further configured to rotate as a single unit with the common shaft, multi-position member, and resistance system when the position selector is engaged with the multi-position member.

4. The apparatus of claim 3 wherein the position selector is configured to be rotated with the lever and with respect to the frame about the working axis past the plurality of selectable positions when the position selector is not engaged with the multi-position member, and the apparatus further comprising end stops disposed adjacent opposing ends of the plurality of selectable positions of the multi-position member, wherein each end stop is configured to engage the lever and to prevent the lever from rotating about the working axis beyond the end stop.

5. The apparatus of claim 2 wherein:

the multi-position member is a multi-apertured plate and each of the plurality of selectable positions is located at an aperture formed in the multi-apertured plate; and the position selector is a pin that is configured to separately engage each of the apertures of the multi-apertured plate.

6. The apparatus of claim 5 wherein the pin is a spring-loaded pop pin that is configured to automatically engage each of the apertures of the multi-apertured plate.

7. The apparatus of claim 1 wherein:

the frame includes:

a pair of frame arms defining the user space between them; and a lever mounting location formed on the frame and positioned such that one lever mounting location is located on each side of the user when the user is located in the user space;

the lever includes:

a working arm rotatably joined to the frame at each of the lever mounting locations such that each of the working arms rotates within or about one of said lever mounting locations adjacent each side of the user when the user is located in the user space.

8. The apparatus of claim 7 wherein, between the handle and the lever mounting location, each working arm is rigid and does not change shape when the lever is moved in the concentric direction or is moved in the eccentric direction.

9. The apparatus of claim 7 wherein the handle comprises an EZ curl bar having opposing ends that are each mounted to one of the working arms with bearings such that the EZ curl bar is capable of rotating about a handle axis that extends through the opposing ends of the EZ curl bar.

10. The apparatus of claim 7 further comprising an arm rest on each of the working arms that is configured to be contacted by a portion of an arm of the user when the user is located in the user space and to receive a user force from the user that acts against the resistance force when the lever is moved in the concentric direction, wherein each arm rest is configured to move laterally with respect to the user space and to be selectively fixed at a selected lateral position.

11. The apparatus of claim 10 further comprising:

a receiver mounted to each of the working arms and having an opening extending laterally through the receiver with respect to the user space, an elongate portion slidably received within the opening of the receiver such that the elongate portion of the arm rest is configured to slide laterally within the opening to position the arm rest at a plurality of lateral positions; and a multi-position member that is carried by one of the arm rest or the receiver and that provides a plurality of selectable positions that each correspond with a separate lateral position; and a position selector that is carried by the other one of the arm rest and the receiver and that is configured to selectively engage each of the selectable positions of the multi-position member to selectively hold the arm rest at a selected lateral position.

12. The apparatus of claim 11 wherein:

the multi-position member comprises apertures disposed at two or more lateral positions along the elongate portion;

the position selector is a pin that is configured to separately engage each of the apertures disposed along the elongate portion.

13. The apparatus of claim 12 wherein the pin is a is a spring-loaded pop pin that is configured to automatically engage each of the apertures disposed along the elongate portion.

14. The apparatus of claim 1 further comprising a seat disposed in the user space, wherein the seat includes a bottom support and a lumbar support.

15. The apparatus of claim 1 wherein the resistance system comprises a weight stack comprising a plurality of weights that can be selectively activated in order to vary the resistance force.

16. A method for exercising latissimus dorsi muscles ("lats") of a user, the method utilizing an exercise apparatus comprising a frame providing a user space in which the user is located when exercising the lats using the apparatus; a lever having a handle and rotatably mounted to the frame, the lever configured to be rotated with respect to the frame by the user via the handle about a working axis through a working range of motion ("ROM") in a concentric direction starting at a first rotational position and ending at a second rotational position and configured to be rotated in an eccentric direction that is opposite the concentric direction and ends at the first rotational position, wherein the lever includes a rigid working arm configured to force an arm of the user to maintain a substantially constant angle between a forearm and an upper arm of the user throughout the working ROM to isolate the lats; a resistance system; and a range selector configured to selectively couple and decouple the lever with the resistance system and to selectively modify the working ROM, the method comprising:

a) positioning the user in the user space of the apparatus;

b) grasping the handle of the lever;

c) engaging the working arm to force an arm of the user to maintain a substantially constant angle between a forearm and an upper arm of the user throughout the working ROM to isolate the latissimus dorsi muscles; and d) rotating the lever against a resistance force provided by the resistance system in the concentric direction from the first rotational position to the second rotational position, thereby performing a lat pullover exercise with minimized bicep activation.

17. The method of claim 16, further comprising:

a) dynamically adjusting the working ROM by manipulating the lever to a new rotational position, causing a spring-loaded pop pin of the range selector to automatically engage a different aperture of a multi-apertured plate of the range selector corresponding to the new rotational position; and b) thereby establishing a new working ROM for the lever, wherein the new working ROM is inversely related to an angle formed between a reference line and the working arm at the new rotational position.

18. The method of claim 16, further comprising, subsequent to rotating the lever in the concentric direction, reducing a user-applied force on the lever, and allowing counterweights coupled to the lever to automatically bias the lever to return to the first rotational position, thereby automatically resetting the lever for a subsequent concentric phase of exercise.

19. The method of claim 16, further comprising, prior to positioning the user in the user space, laterally adjusting at least one arm rest of the apparatus by moving the arm rest to a desired lateral position along a working arm of the lever and allowing a spring-loaded pop pin associated with the arm rest to automatically engage a selected aperture corresponding to the desired lateral position, thereby selectively fixing a lateral width of the user space to accommodate a user's physique.

20. The method of claim 16, wherein the lever comprises a C-shaped working arm having a first end, a second end, and a middle portion connecting the first and second ends, with the handle located on the second end, the method further comprising:

positioning an elbow of the user at the middle portion of the C-shaped working arm; and maintaining the substantially constant angle between the forearm and upper arm by directing the user's upper arm to extend substantially parallel with the first end of the C-shaped working arm and directing the user's forearm to extend substantially parallel with the second end of the C-shaped working arm during the rotation of the lever.

* * * * *